US007887382B1

(12) United States Patent
Kasper et al.

(10) Patent No.: US 7,887,382 B1
(45) **Date of Patent: *Feb. 15, 2011**

(54) MULTIPURPOSE WATER RESCUE APPARATUS

(76) Inventors: Bryan J. Kasper, 1089 Kubacki Rd., Gaylord, MI (US) 49735; Alfred A. Dyer, 6372 US 2 West, Naubinway, MI (US) 49762

( * ) Notice: Subject to any disclaimer, the term of this patent is extended or adjusted under 35 U.S.C. 154(b) by 0 days.

This patent is subject to a terminal disclaimer.

(21) Appl. No.: 12/100,845

(22) Filed: Apr. 10, 2008

Related U.S. Application Data

(63) Continuation-in-part of application No. 11/318,021, filed on Dec. 27, 2005, now Pat. No. 7,410,401.

(51) Int. Cl.
*B63C 9/00* (2006.01)

(52) U.S. Cl. ..... 440/84

(58) Field of Classification Search ..... 441/80, 441/82, 84, 85; 405/68
See application file for complete search history.

(56) References Cited

U.S. PATENT DOCUMENTS 2,722,696 A * 11/1955 Johnson ..... 441/84
4,990,114 A 2/1991 LeBlanc, Jr.
5,687,664 A 11/1997 Sofian
5,704,447 A 1/1998 Doyle
6,050,869 A 4/2000 Kellett
RE36,965 E 11/2000 Salvemini
6,190,222 B1 2/2001 Senger
6,568,976 B2 5/2003 Anderson et al.
6,575,799 B1 6/2003 Stimpson et al.
6,659,823 B1 12/2003 Mosna et al.
7,172,367 B2 * 2/2007 Jeory ..... 405/70
7,410,401 B1 * 8/2008 Kasper et al. ..... 441/80

* cited by examiner

*Primary Examiner*—Ed Swinehart
(74) *Attorney, Agent, or Firm*—John D. Gugliotta, PE, Esq.

(57) ABSTRACT

An apparatus that provides for rescue of victims trapped in a body of water is disclosed. The invention utilizes a conventional fire hose as the main component of the invention. One end of the hose is capped with a retrieval end comprising a solid cap with a swivel based tether. The end is also provided with a pair of removable rudders which aid in the guiding have said apparatus in a controlled manner through the water. The opposite end of the fire hose is capped with a pressurizing mechanism that allows for the inflation and deflation of the fire hose. When inflated, the preferred embodiment floats upon the water surface thus providing for simplified water rescues. The invention is also envisioned as providing simplified ice rescues as well. The use of the present invention provides a greatly simplified method of water rescue which not only provides for quicker rescues for victims, but increased safety for rescue personnel as well.

5 Claims, 3 Drawing Sheets

MULTIPURPOSE WATER RESCUE APPARATUS

RELATED APPLICATIONS

The present application is a Continuation in Part of U.S. Ser. No. 11/318,021, filed on Dec. 27, 2005 now U.S. Pat. No. 7,410,401 and incorporated by reference as if rewritten herein.

BACKGROUND OF THE INVENTION

1. Field of the Invention

The present invention relates generally to rescue apparatuses, and, more particularly, to a multipurpose water rescue apparatus 2. Description of the Related Art Those of us who live in areas near water masses such as lakes, rivers, reservoirs or even large retention ponds, know all too well of the hazards associated with such bodies of water. All too often the news is filled with stories of unfortunate individuals who misunderstood the dangers associated with entering such waters. Even more unfortunate is when rescuers are killed or injured while trying to rescue them. These unfortunate incidents quickly spread out of control not only due to the danger of the water, but also to the urgency of the need to reach the individuals. What was a dangerous situation when one person became trapped in the water does not become any safer when rescue personnel show up and enter the water as well. Accordingly, there is a need for a means by victims that have fallen into a body of water can be quickly rescued without endangering the lives of the rescue workers themselves.

A search of the prior art reveals no patents that read directly on the claims of the instant invention; however, the following references disclose various rescue devices:

U.S. Pat. No. 6,575,799 B1, issued in the name of Stimpson et al.;

U.S. Pat. No. 6,050,869, issued in the name of Kellett;

U.S. Pat. No. Re. 36,965, issued in the name of Salvemini;

U.S. Pat. No. 6,190,222 B1, issued in the name of Senger;

U.S. Pat. No. 4,990,114, issued in the name of LeBlanc, Jr.;

U.S. Pat. No. 5,687,664, issued in the name of Sofian; and

U.S. Pat. No. 6,659,823 B1, issued in the name of Mosna et al.

U.S. Pat. No. 5,704,447 to Doyle discloses a step pad which provides a permanent or temporary rescue and utility footing in combination with a rope.

And, U.S. Pat. No. 6,568,976 B2, issued in the name of Anderson et al. discloses a water flotation cushion with deployable tether.

Consequently, a need has been felt for providing an apparatus and method for water based rescues.

SUMMARY OF THE INVENTION

It is therefore an object of the present invention to provide an improved multipurpose rescue tool.

It is a feature of the present invention to provide an improved rescue device comprised of a directionally-controlled retrieval unit adapted for threaded, sealable attachment to a regulator unit. Once attached, the retrieval unit and regulator unit are adapted to hold compressed air, thereby being floatable on water.

Briefly described according to one embodiment of the present invention, an apparatus that provides for rescue of victims trapped in a body of water is disclosed. The invention utilizes a conventional fire hose as the main component of the invention. One end of the hose is capped with a retrieval end comprising a solid cap with a swivel based tether. Said end is also provided with a pair of removable rudders which aid in the guiding have said apparatus in a controlled manner through the water. The opposite end of the fire hose is capped with a pressurizing mechanism that allows for the inflation and deflation of the fire hose. When inflated, the preferred embodiment floats upon the water surface thus providing for simplified water rescues. The invention is also envisioned as providing simplified ice rescues as well.

The use of the present invention provides a greatly simplified method of water rescue which not only provides for quicker rescues for victims, but increased safety for rescue personnel as well.

Additionally, the present invention can be used to contain oils spills at an accident scene, or on a lake or river to contain oil spills.

An advantage of the present invention is that it is particularly adapted to assist in water based lifesaving operations.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
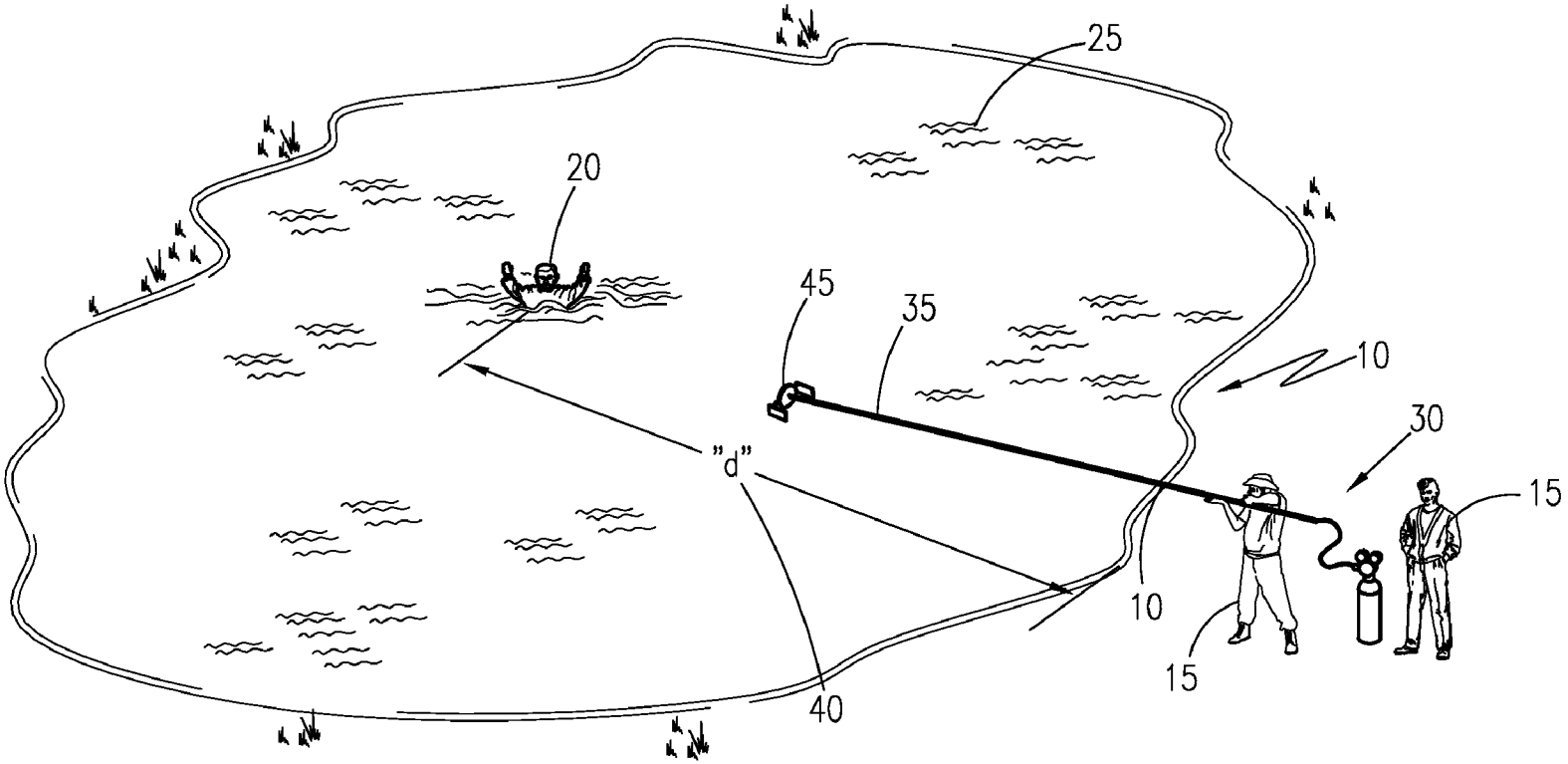
FIG. 1 is an isometric representation of the multipurpose water rescue apparatus 10 shown in a utilized state, according to the preferred embodiment of the present invention.

Referring now to FIG. 1, isometric representation of the multipurpose water rescue apparatus 10 shown in a utilized state, according to the preferred embodiment of the present invention is disclosed. The multipurpose water rescue apparatus 10 is utilized by a series of rescue personnel 15 when a victim 20 is trapped in a body of water 25. The body of water can be an ocean, a lake, a river, a stream, drainage canal, ditch, reservoir, retention basin or the like, and as such, any specific type of body of water 25 is not intended to be a limiting factor of the present invention. Additionally, the multipurpose water rescue apparatus 10 can be used when the body of water 25 is covered by a layer of ice as well. In fact, the multipurpose water rescue apparatus 10 works exceptionally well on ice, due to the ability of the multipurpose water rescue apparatus 10 to be pushed the victim 20 without stepping onto the ice thus causing further danger and creating additional risk for the rescue personnel 15. The rescue personnel 15 would set up the multipurpose water rescue apparatus 10 on a shoreline 30 near the victim 20. Said multipurpose water rescue apparatus 10 would then be pushed in the general direction of the victim 20. The multipurpose water rescue apparatus 10, whose middle section is comprised of a conventional fire hose 35, is of a rigid nature formed by pressurized air. Said pressurization process will be described in greater detail herein below, and thus forces the multipurpose water rescue apparatus 10 to float upon the water. As the conventional fire hose 35 can be any length and even two or more conventional fire hose 35 can be joined together to form longer lengths, a victim 20 at any distance 'd' 40 can be reached. Additionally, the conventional fire hose 35 can be transported to the body of water 25 in a rolled or folded state, and then transformed into a rigid state at the shoreline 30. This feature saves the body of water 25 the added time of attempting to locate a rescue pole, which even if one should be located, its length will be severely limited and will most likely not float upon the surface. As the far end of the multipurpose water rescue apparatus 10 reaches the victim 20, said victim 20 can grasp a gripping lanyard 45 and be pulled back to the shoreline 30 by the rescue personnel 15.

Figure 2:
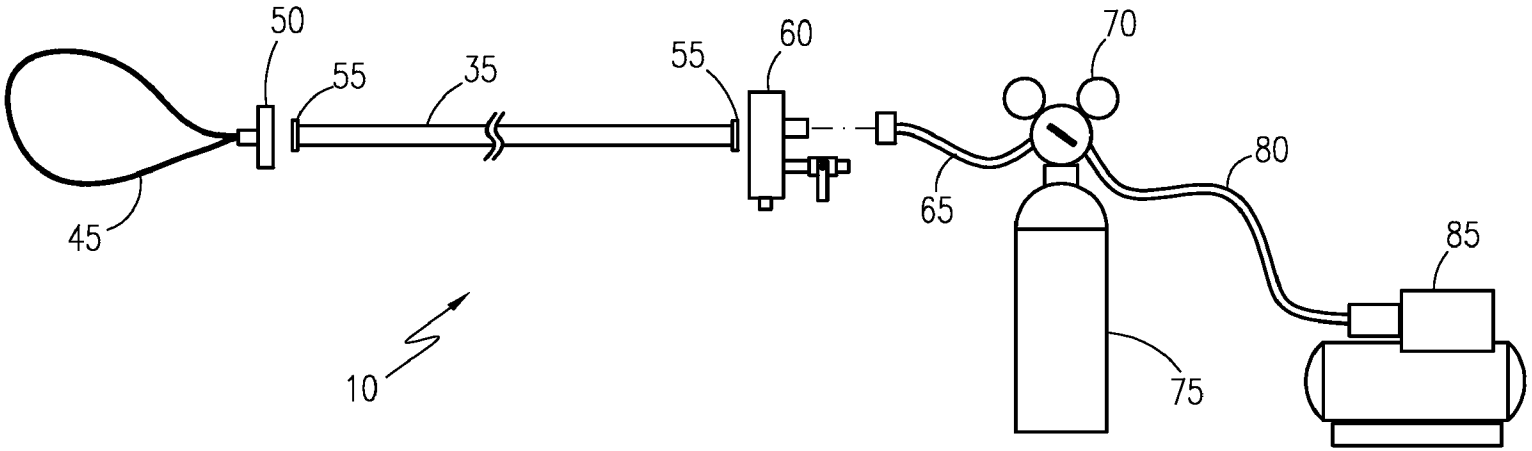
FIG. 2 is an exploded view of the multipurpose water rescue apparatus 10, according to the preferred embodiment of the present invention.

Referring now to FIG. 2, an exploded view of the multipurpose water rescue apparatus 10, according to the preferred embodiment of the present invention is depicted. The main length comprising component of the multipurpose water rescue apparatus 10 is the body of water 25. As aforementioned described, the conventional fire hose 35 is of the same type and nature as typically found on a fire truck or similar rescue vehicle. At one end of the conventional fire hose 35 is located a retrieval end 50 which affixes in an airtight manner to a connection fitting 55 as normally provided on the conventional fire hose 35. The retrieval end 50 comprises a solid cap 150 with a swivel based tether 95. The gripping lanyard 45 is permanently affixed to the retrieval end 50 along its centerline. Additional information on the retrieval end 50 will be provided herein below. At the opposite end of the conventional fire hose 35, a regulator unit 60 is provided which affixes to the corresponding connection fitting 55 in an airtight manner. The regulator unit 60 will be described in greater detail herein below. The chamber formed by the retrieval end 50, the conventional fire hose 35, and the regulator unit 60 is airtight, and such, allows flotation of the multipurpose water rescue apparatus 10 when placed upon a body of water 25 (as shown in FIG. 1) The regulator unit 60 contains a series of fittings which allow for the connection of a pressuring system. The pressurizing system consists of a pressurizing hose 65, which connects to the regulator unit 60, and forms a common union between said regulator unit 60 and a pressure regulator 70. The pressure regulator 70 is well known in the art and allows adjustment of air pressure and flow. The pressure regulator 70 is directly connected to a compressed air canister 75. The compressed air canister 75 is also of a common nature typically used by fire fighters and other rescue personnel as part of a self contained breathing apparatus. Such commonality between the conventional fire hose 35 and the compressed air canister 75 reduces duplicate components that must be carried by rescue personnel on rescue vehicles, and ensures that the necessary components to fabricate the multipurpose water rescue apparatus 10 will be present. As an added benefit, the pressurizing apparatus also includes a auxiliary pressurizing hose 80, which connects to an air compressor 85. The air compressor 85 is envisioned to be of the type commonly used to power air tools, inflate tires and the like, and as such, may also be present on rescue vehicles as part of a common base of equipment.

Figure 3:
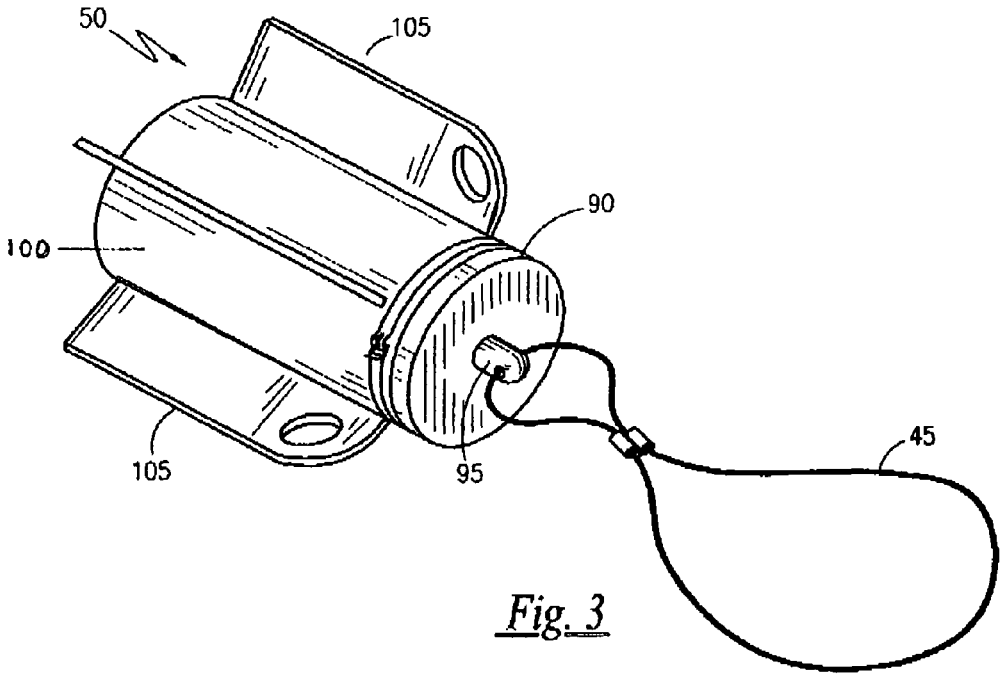
FIG. 3 is an isometric representation of the retrieval end 50 as used with the multipurpose water rescue apparatus 10; and, FIG. 4 is an isometric representation of the regulator unit 60 as used with the multipurpose water rescue apparatus 10.

Referring next to FIG. 3, an isometric representation of the retrieval end 50 as used with the multipurpose water rescue apparatus 10 is shown. The retrieval end 50 is envisioned to be made of brass, aluminum or similar metal.

The gripping lanyard 45 is attached to a first base cover 90 via a swivel based tether 95. The swivel based tether 95, while swiveling in a 360 degree path, still maintains an air tight seal. It is envisioned that other objects such as lifesavers, other lifelines, tools, equipment and the like, can be attached via the gripping lanyard 45 and passed to the victim 20 (as shown in FIG. 1). The connection means afforded by the first base cover 90 to the connection fitting 55 (as shown in FIG. 2) is of the same type as used with conventional fire hoses, although all types of connections such as threaded connections, quick-connect, and others could also be used, and as such, should not be interpreted as a limiting factor of the present invention. A number of rudder plates 105 are located around the perimeter of a removable connection tube 100. Although any number can be used, shown are four rudder plates 105 located on the perimeter surface of the connection tube 100 at 90 degrees opposite of one another. The connection tube 100 are used in conjunction with a pair of removable rudder plates 105 to assist the guiding of the retrieval end 50 through the body of water 25 (as shown in FIG. 1) The rudder plates 105 will allow the multipurpose water rescue apparatus 10 to travel in a more straight path. It is anticipated that the rudder plates 10 can be removable and should the rudder plates 105 not be needed, the connection tube can be removed from the base cover 90 (such as when the multipurpose water rescue apparatus 10 is used upon ice). This is envisioned as that this removal can be accomplished without the use of additional tools.

Figure 4:
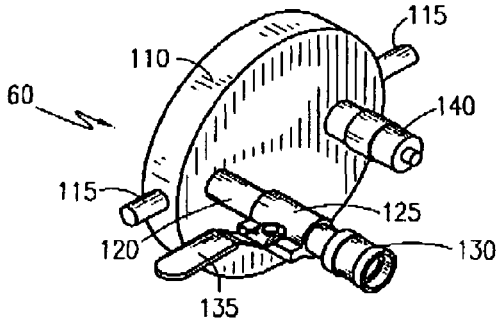

Referring finally to FIG. 4, an isometric representation of the regulator unit 60 as used with the multipurpose water rescue apparatus 10 is shown. The regulator unit 60 is comprised of a second base cover 110 also made of solid brass or similar construction. The connection means afforded by the second base cover 110 to the connection fitting 55 (as shown in FIG. 2) is of the same type as used with conventional fire hoses, although all types of connections such as threaded connections, quick-connect, and others could also be used, and as such, should not be interpreted as a limiting factor of the present invention. To assist in the connection of the second base cover 110 to the connection fitting 55 (as shown in FIG. 2), a series of two cylindrical appendages 115 located on the perimeter of the second base cover 110 at 180 degrees opposite to one another. These appendages are used to tighten the cap to the hose, and it is envisioned that in an alternate embodiment this function will be filled by a series of four slots to allow rescue personnel to use their standard spanner wrench to tighten. A fill connection 120 is provided on the face of the second base cover 110 that connects to a fill valve 125. The fill valve 125 is in firm connection with a quick connect fitting 130 which connects to the pressurizing hose 65 (as shown in FIG. 2). A valve handle 135 is provided on the fill valve 125. The fill valve 125 and the valve handle 135 are used to control the flow of air into the multipurpose water rescue apparatus 10. When closed, the fill valve 125 allows for the removal of the pressurizing hose 65 (as shown in FIG. 2) while the air pressure inside of the multipurpose water rescue apparatus 10 is maintained. It is also envisioned that the fill valve 125 and the valve handle 135 could be opened to allow for the release of the air pressure after use of the multipurpose water rescue apparatus 10 as well. Finally, an air pressure relief valve 140, is provided on the face of the second base cover 110 to prevent over pressurization of the multipurpose water rescue apparatus 10 and possible catastrophic failure during use. The air pressure relief valve 140 also functions as a release mechanism of air pressure contained within the multipurpose water rescue apparatus 10 as well.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. Upon initial purchase or acquisition of the multipurpose water rescue apparatus 10, by a group of rescue personnel 15 such as a fire department, water rescue group, Coast Guard, Navy, or the like, suitable training on its setup and use would be required. It is envisioned that the multipurpose water rescue apparatus 10 would be stored in or on a rescue vehicle such as a fire truck, rescue boat, or similar rescue vehicle. At this point in time, the multipurpose water rescue apparatus 10 would be ready for deployment and use.

Upon becoming alerted to the presence of a victim 20 in a body of water 25, the rescue personnel 15 would respond to the body of water 25 and quickly setup the multipurpose water rescue apparatus 10 on the shoreline 30. To begin assembly, the rescue personnel 15 would select a conventional fire hose 35 from their rescue vehicle that is of suitable length to span the distance 'd' 40 to the victim 20. At one end of the conventional fire hose 35, the retrieval end 50 would be affixed. Should conditions warrant the use of the removable rudder plates 105, they would be affixed using the removable connecting arms 100. At the other end of the conventional fire hose 35 the regulator unit 60 would be affixed. Next, the pressurizing hose 65 would be connected to the quick connect fitting 130 and the fill valve 125 opened. With the pressure regulator 70 attached to either a compressed air canister 75 or an air compressor 85 through the auxiliary pressurizing hose 80, the pressure regulator 70 would be activated to pressurize the multipurpose water rescue apparatus 10. With the multipurpose water rescue apparatus 10 in its elongated and rigid shape, it is pushed toward the victim 20.

The multipurpose water rescue apparatus 10 will float upon the surface of the body of water 25 and as such can be guided using feedback by the rescue personnel 15. When the retrieval end 50 reaches the victim 20, the victim 20 would grasp the gripping lanyard 45, whereupon said victim 20 can be pulled back to the shoreline 30 by the rescue personnel 15 and appropriate first aid, if any, can be rendered. At this point in time, the multipurpose water rescue apparatus 10 can be depressurized, deflated and stowed.

To depressurize the multipurpose water rescue apparatus 10, the user can open the fill valve 125 or activate the pressure release mechanism of the air pressure relief valve 140. With pressure removed, the retrieval end 50 and the regulator unit 60 can be removed from the conventional fire hose 35. The conventional fire hose 35 can be rolled, folded and/or properly stowed to allow for future use in a repeating manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. An apparatus that provides for rescue of victims trapped in a body of water comprising:

a linearly elongated fire hose having a distal end opposite a proximal end;

a cylindrical connection housing having a first end opposite a second end, said first end affixable to said distal end of said fire hose;

a retrieval end capping said second end and comprising a solid cap with a swivel based connection;

a plurality of rudders attached about a sidewall of said cylindrical connection housing which aid in guiding said apparatus in a controlled manner through the water;

a pressurizing mechanism capping said proximal end that allows for the inflation and deflation of said fire hose;

a gripping lanyard affixed at said swivel based connection; and said proximal end adapted for pulling back said fire hose to a shoreline by rescue personnel;

wherein when inflated, said fire hose floats upon the water surface thus providing for simplified water rescues.

2. The multipurpose water rescue apparatus of claim 1, wherein said gripping lanyard is permanently affixed to said retrieval end along its centerline.

3. The multipurpose water rescue apparatus of claim 1, wherein said pressurizing mechanism is located at said proximal end and comprises:

a regulator unit which affixes to a corresponding connection fitting in an airtight manner;

a chamber formed by said retrieval end, the lire hose and the regulator unit, said chamber being airtight;

a series of fittings in fluid communication with said regulator unit which allow for the connection of a pressuring system.

4. The multipurpose water rescue apparatus of claim 1, wherein said gripping lanyard is attached to said retrieval end in a manner to allow swiveling in a 360 degree path while still maintains an air tight seal.

5. An apparatus that provides for rescue of victims trapped in a body of water comprising:

a linearly elongated fire hose having a distal end opposite a proximal end;

a cylindrical connection tube having a first end connectable to said distal end, said first end opposite a retrieval end capping said connection tube and comprising a solid cap with a swivel based connection;

four rudder plates located on a perimeter surface of said connection tube at 90 degrees opposite of one another, said rudder plates for allowing the multipurpose water rescue apparatus to travel in a substantially straight path when retrieved and which aid in guiding said apparatus in a controlled manner through the water;

a pressurizing mechanism capping said proximal end that allows for the inflation and deflation of said fire hose;

a gripping lanyard affixed to said connection tube at said distal end; and said proximal end adapted for pulling back said tire hose to a shoreline by rescue personnel;

wherein when inflated, said fire hose floats upon the water surface thus providing for simplified water rescues.

* * * * *